US007987841B2

(12) United States Patent
Bernstein et al.

(10) Patent No.: US 7,987,841 B2
(45) Date of Patent: Aug. 2, 2011

(54) PNEUMATIC TOY LAUNCHING APPARATUS

(75) Inventors: Michael Bernstein, Hermosa Beach, CA (US); Gabriel Carlson, Los Angeles, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 89 days.

(21) Appl. No.: 12/387,419

(22) Filed: Apr. 30, 2009

(65) Prior Publication Data

US 2009/0272370 A1 Nov. 5, 2009

Related U.S. Application Data

(60) Provisional application No. 61/126,097, filed on Apr. 30, 2008.

(51) Int. Cl.
*F41B 11/00* (2006.01)

(52) U.S. Cl. ..... 124/64; 446/197

(58) Field of Classification Search ..... 124/64; 446/197

See application file for complete search history.

(56) References Cited

OTHER PUBLICATIONS http://www.google.com/products?hl=en&q=super+slammers &um=1&ie=UTF-8 &ei=PxgXSo34JoTDtwfQ7PzuDA&sa=X &oi=product_result_group&resnum=1&ct=title, retrieved Jun. 3, 2009.

*Primary Examiner* — Troy Chambers
(74) *Attorney, Agent, or Firm* — Tope-McKay Associates

(57) ABSTRACT

A pneumatic launching apparatus is described. The pneumatic toy launching apparatus includes a collapsible bellows with an outlet configured to allow air to exit the collapsible bellows. A gripping device is attached with the collapsible bellows, and a platform is attached with the gripping device. A launching tube is attached with the platform and is formed to releasably engage a launchable object. An air transfer tube connects the collapsible bellows and the launching tube. Upon compression of the collapsible bellows against a surface, air travels from the collapsible bellows, through the air transfer tube, and out of the launching tube to launch an object attached with the launching tube. A rotating mechanism attached with the platform allows rotation of multiple launching tubes. The gripping device further comprises a rotation actuator to induce rotation of the platform.

4 Claims, 6 Drawing Sheets

PNEUMATIC TOY LAUNCHING APPARATUS

PRIORITY CLAIM

The present application is a non-provisional patent application, claiming the benefit of priority of U.S. Provisional Application No. 61/126,097, filed on Apr. 30, 2008, entitled, "Pneumatic Toy Launching Apparatus."

BACKGROUND OF THE INVENTION (1) Field of Invention

The present invention relates to a pneumatic launching apparatus and, more particularly, to a pneumatic launching apparatus with a gripping device.

(2) Description of Related Art

Toy launchers are well known in the art. Toy launchers may be powered by multiple means including pneumatic means, whereby compressed air is used to power the toy launcher. The majority of pneumatic toy launchers which exist are formed as part of a launch ramp, track set, or other stationary structures which cannot be readily transferred from location to location.

Thus, a continuing need exists for a pneumatic toy launcher which is portable and can be used to launch toys onto a variety of surfaces.

SUMMARY OF INVENTION

The present invention relates to a pneumatic launching apparatus. The pneumatic launching apparatus comprises a collapsible bellows with a top portion and a bottom portion. The top portion includes an outlet configured to allow air to exit the collapsible bellows. Additionally, a gripping device is attached with the collapsible bellows, and a platform is attached with the gripping device. At least one hollow launching tube is attached with the platform, wherein the at least one hollow launching tube is formed to releasably engage an object. An air transfer tube connects the collapsible bellows with the at least one hollow launching tube. Upon compression of the collapsible bellows, air travels from the collapsible bellows, through the air transfer tube, and out of the at least one hollow launching tube to launch an object attached with the at least one hollow launching tube.

In another aspect, the gripping device is a handle, such that a user may grip the handle and compress the bottom portion of the collapsible bellows against a surface to launch the object attached with the at least one hollow launching tube.

In another aspect, the at least one hollow launching tube is pivotally attached with the platform such that the object may be launched at a plurality of angles.

In yet another aspect, a rotating mechanism is attached with the platform and configured to induce rotation of the platform.

In another aspect, the gripping device further comprises a rotation actuator operably connected with the rotating mechanism to induce rotation of the platform.

In another aspect, an adjustable launch adaptor is detachably attached with the launching element and configured to releasably engage a toy such that a toy may be launched at a plurality of angles.

Finally, as can be appreciated by one in the art, the present invention also comprises a method for forming a pneumatic launching apparatus described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a pneumatic launching apparatus and, more particularly, to pneumatic launching apparatus with a gripping device. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
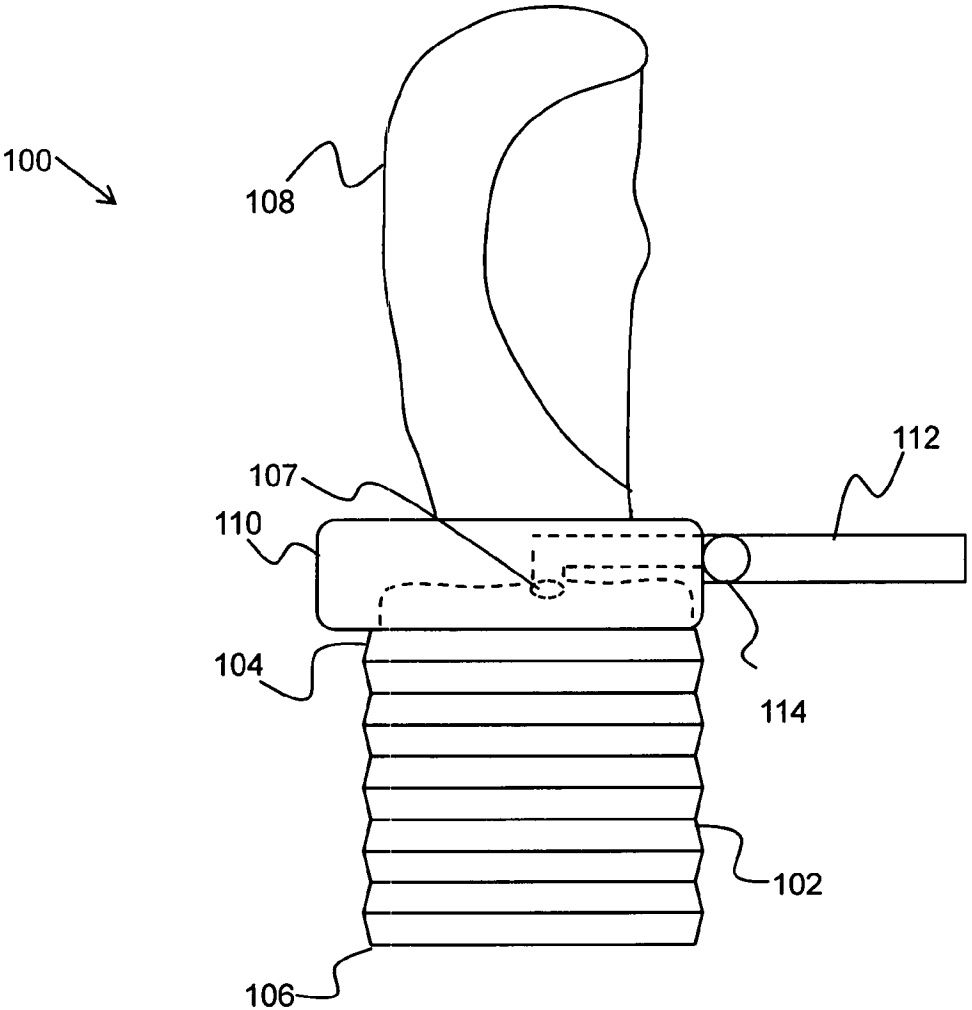
FIG. 1 is a side-view illustration of a pneumatic launching apparatus according to the present invention.

The present invention relates to a pneumatic launching apparatus. The pneumatic launching apparatus is configured to launch an object, non-limiting examples of which include a toy vehicle (e.g., car, motorcycle, airplane) and figurine. FIG. 1 illustrates a pneumatic launching apparatus 100 comprising a collapsible bellows 102 having a top portion 104 and a bottom portion 106. The top portion 104 includes an outlet 107 configured to allow air to exit the collapsible bellows 102. A gripping device 108 is attached with the collapsible bellows 102. The gripping device 108 may be formed in any suitable size or shape which allows a user to easily manually grip the gripping device. Non-limiting examples of which include an elongated handle, as shown in FIG. 1, and a handle having a slot for a user's fingers. A platform 110 is attached with the gripping device 108 to connect a hollow launching tube 112 to the collapsible bellows 102. The launching tube 112 may be formed in any suitable shape provided that it includes a hollow center. In a desired aspect, the launching tube 112 is pivotally attached with the platform 110. As a non-limiting example, the launching tube 112 is pivotally attached with the platform 110 via a pivotable attachment 114, such as a hinge. The pivotable attachment 114 allows a user to adjust the angle of the launching tube 112 in order to launch an object at multiple angles.

Figure 2:
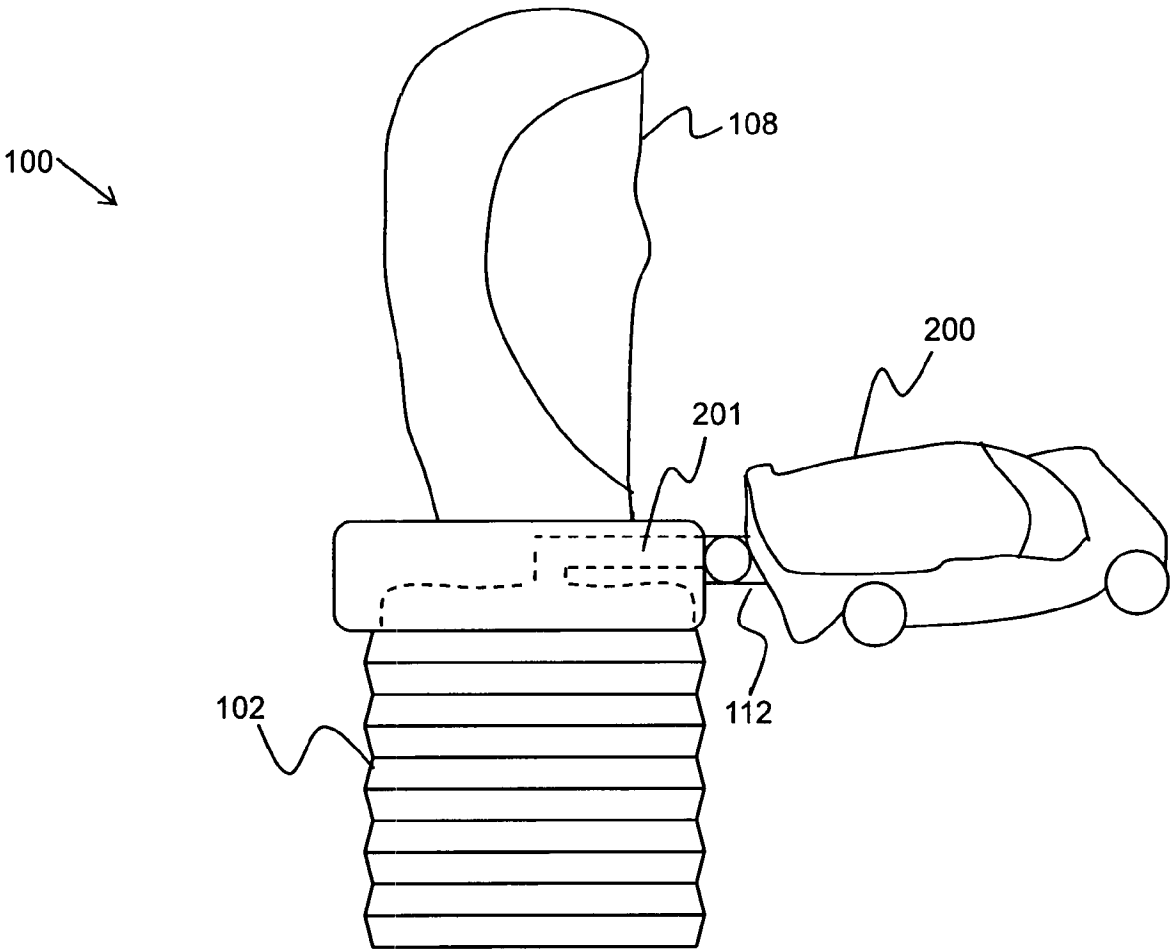
FIG. 2 is a side-view illustration of a pneumatic launching apparatus shown with a launchable object according to the present invention.

As illustrated in FIG. 2, to launch an object from the pneumatic launching apparatus 100, a user attaches an object 200, such as a toy vehicle, to the launching tube 112. The launching tube 112 is formed to releasably engage the object 200, such that the object is attached to the launching tube 112 until launched. The launching tube is sized and shaped to fit inside a receiving element, such as a hollow slot, of the object 200 for a secure, but releasable attachment. As a non-limiting example, the object 200 includes a hollow receiving element having a size and shape which corresponds to the launching tube 112, such that a user slides the object 200 onto the launching tube 112. The object 200 is then held in place on the launching tube 112 until launched. The pneumatic launching apparatus 100 further comprises an air transfer tube 201 which fluidly connects the collapsible bellows 102 to the launching tube 112. To launch the object 200, a user grips the gripping device 108 and compresses the collapsible bellows 102 against a surface. For example, a user slams the collapsible bellows 102 down against the ground. Air travels from the collapsible bellows 102, through the air transfer tube 201, and out the launching tube 112 to launch the object 200 attached with the launching tube 112. Therefore, the object 200 is not released from the launching tube 112 until the air pressure causes it to be launched.

Figure 3:
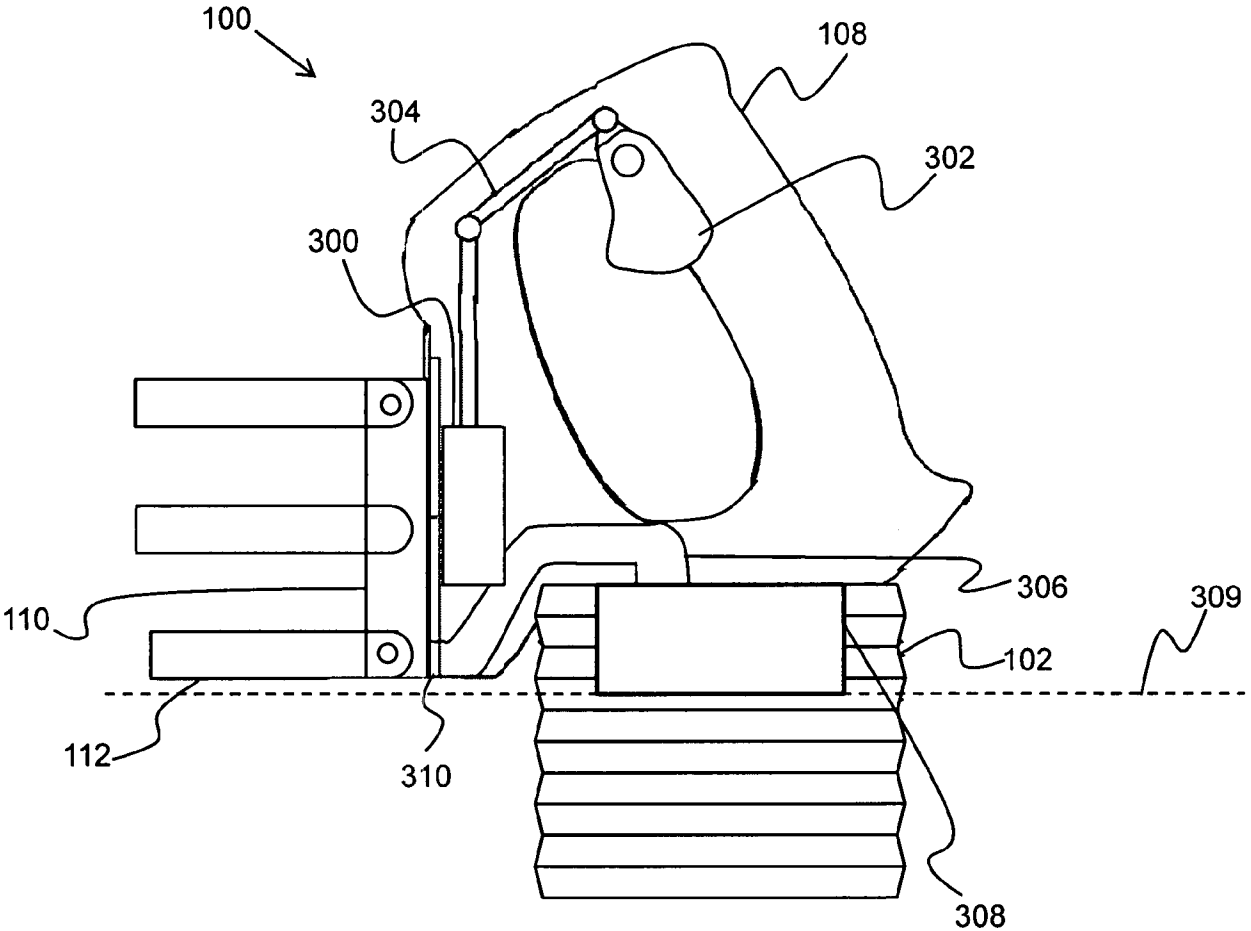
FIG. 3 is a sectional-view illustration of a pneumatic launching apparatus having multiple launching tubes according to the present invention.

In a desired aspect, and as shown in FIG. 3, the pneumatic launching apparatus 100 includes a rotating mechanism 300 attached with the platform 110. The rotating mechanism 300 is configured to induce rotation of the platform 110. As illustrated in FIG. 3, the pneumatic launching apparatus 100 may include multiple launching tubes 112 to allow for launching of multiple objects.

The gripping device 108, shown as, although not limited to, a slotted handle, further comprises a rotation actuator 302 which is operably connected with the rotating mechanism 300 to induce rotation of the platform 110. The rotation actuator 302 is connected with the rotating mechanism 300 through a series of pivotally connected linkage elements 304. As can be appreciated by one skilled in the art, the rotation actuator 302 may be a trigger as shown in FIG. 3, a push button, or the like. As a user pulls the trigger (or pushes a button), the linkage elements 304 are caused to move, which thereby induces rotation of the rotating mechanism 300 and, consequently, the platform 110. Rotation of the platform 110 aligns one of the launching tubes 112 with the air transfer tube 306, similar to a revolver mechanism. When a user compresses the collapsible bellows 102 against a surface, air travels from the collapsible bellows 102, through the air transfer tube 306, and out the launching tube 112 to launch an object attached with the launching tube 112 which is aligned with the air transfer tube 306.

As illustrated in FIG. 3, the pneumatic launching apparatus 100 further comprises a stopper element 308. The stopper element 308 provides a limit point 309 for the compression of the collapsible bellows 102. The limit point 309 ensures that impact of the collapsible bellows 102 against a surface does not extend to and damage the platform 110 and launching tubes 112.

Additionally, the pneumatic launching apparatus includes a seal 310 positioned between the platform 110 and the air transfer tube 306 to ensure that air is not lost on its way to the launching tube 112.

Figure 4:
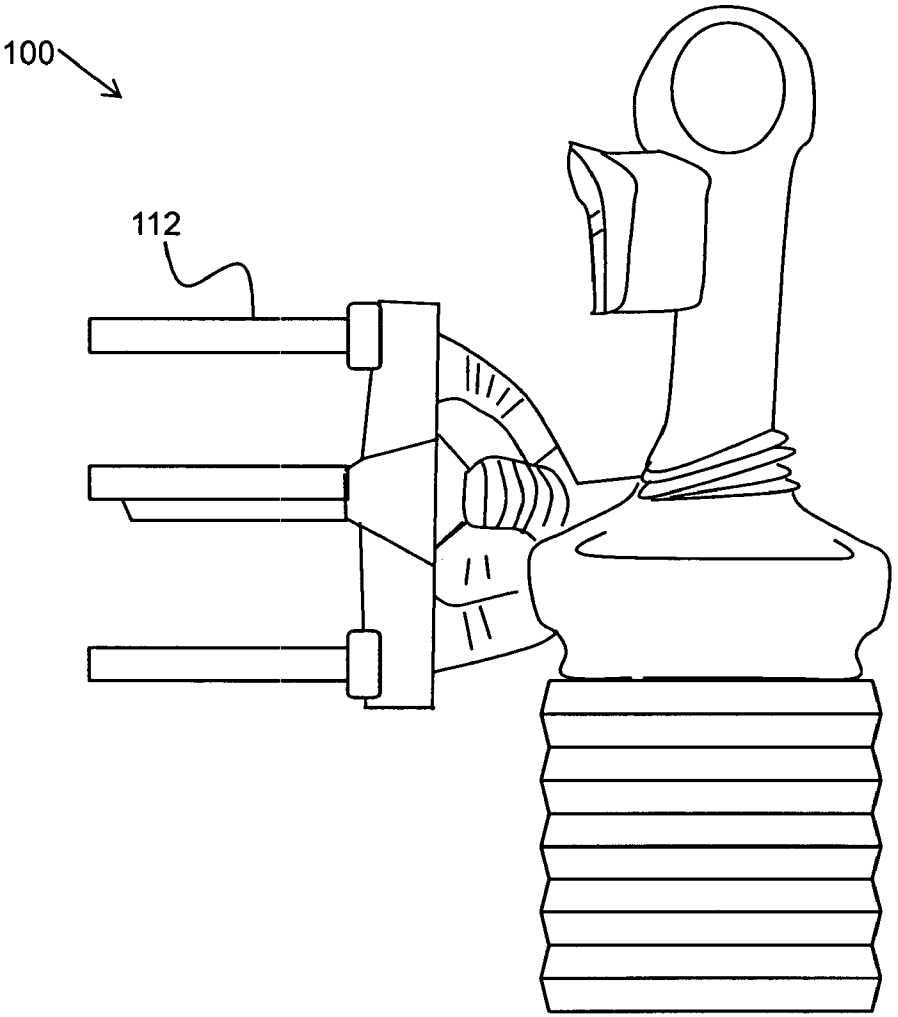
FIG. 4 is a side-view illustration of a pneumatic launching apparatus having multiple launching tubes according to the present invention.
Figure 5:
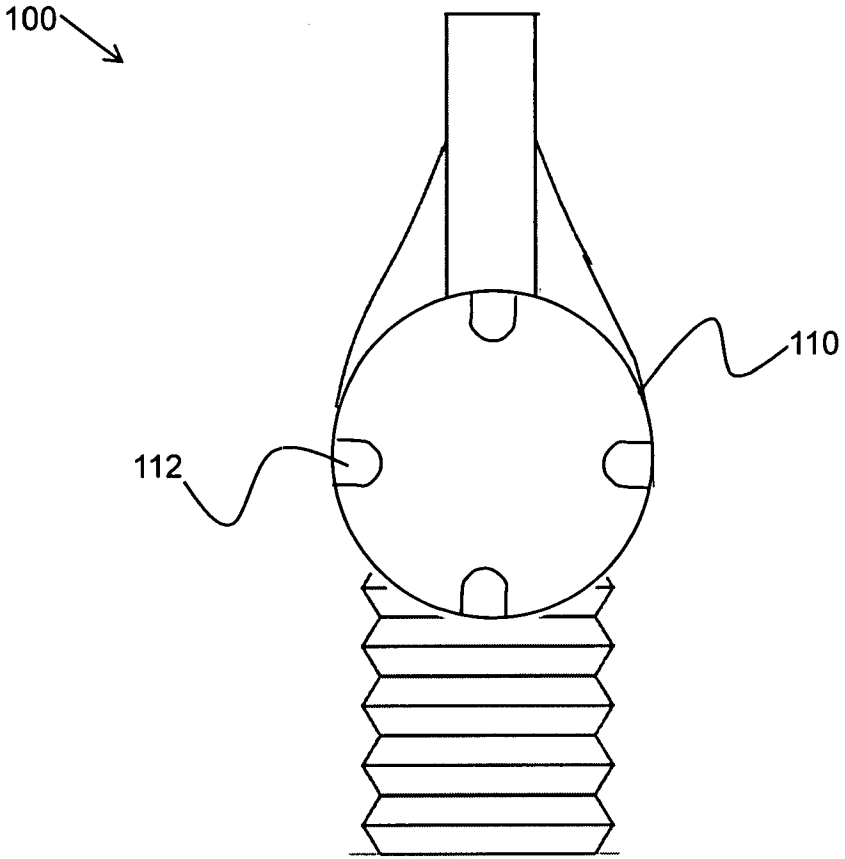
FIG. 5 is a front-view illustration of a pneumatic launching apparatus having multiple launching tubes.
Figure 6:
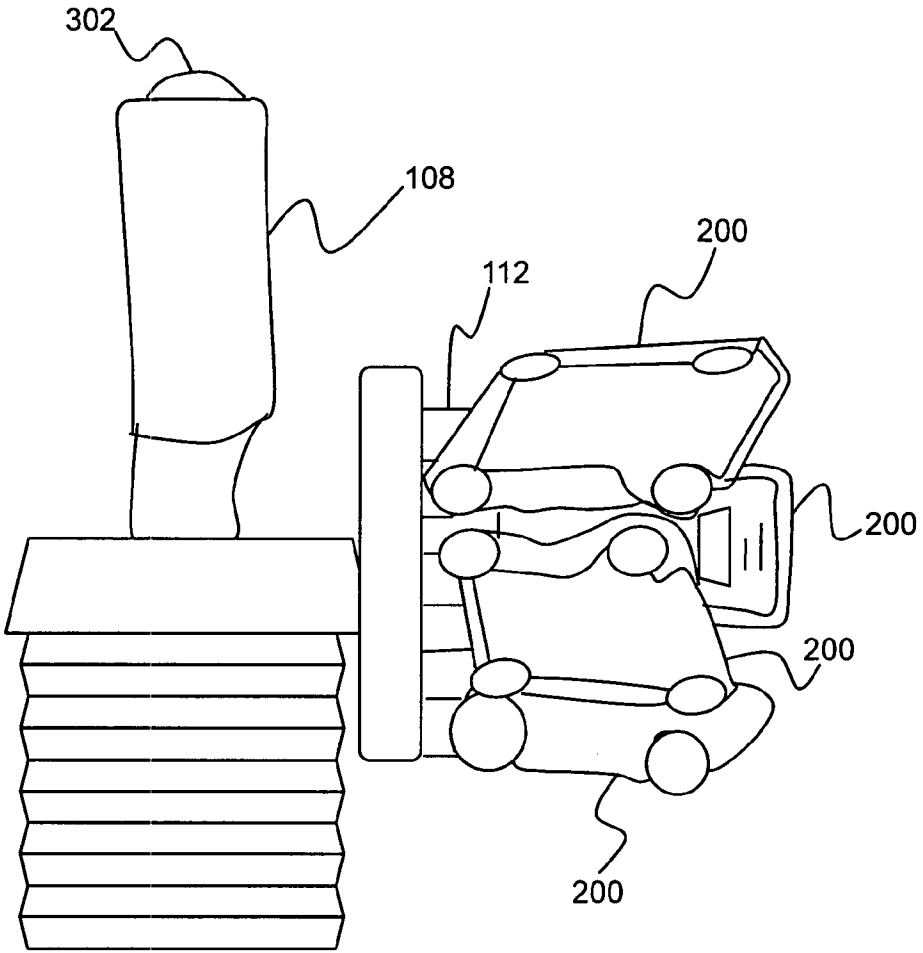
FIG. 6 is a side-view illustration of a pneumatic launching apparatus having multiple launching tubes shown with multiple launchable objects.

FIG. 4 depicts a side-view illustration of a pneumatic launching apparatus 100 having multiple launching tubes 112. As shown, the pneumatic launching apparatus 100 includes four launching tubes 112. However, as can be appreciated by one skilled in the art, the pneumatic launching apparatus 100 may include any number of launching tubes 112. FIG. 5 illustrates a front-view of a pneumatic launching apparatus 100. The launching tubes 112 are symmetrically arranged on the platform 110. Finally, FIG. 6 illustrates a pneumatic launching apparatus 100 having multiple launching tubes 112, each attached to an object 200 (e.g., toy vehicle). As shown and although not limited thereto, the rotation actuator 302 is a push button attached with the gripping device 108.

What is claimed is:

1. A pneumatic launching apparatus, comprising:

a collapsible bellows having a top portion and a bottom portion, the top portion having an outlet configured to allow air to exit the collapsible bellows;

a gripping device attached with the collapsible bellows;

a platform attached with the gripping device;

at least one hollow launching tube attached with the platform, wherein the at least one hollow launching tube is formed to releasably engage an object;

an air transfer tube connecting the collapsible bellows and the at least one hollow launching tube, wherein upon compression of the collapsible bellows, air travels from the collapsible bellows, through the air transfer tube, and out of the at least one hollow launching tube to launch an object attached with the at least one hollow launching tube;

wherein the gripping device is a handle, such that a user may grip the handle and compress the bottom portion of the collapsible bellows against a surface to launch the object attached with the at least one hollow launching tube;

further comprising a rotating mechanism attached with the platform configured to induce rotation of the platform; and wherein the gripping device further comprises a rotation actuator operably connected with the rotating mechanism to induce rotation of the platform.

2. A pneumatic launching apparatus as set forth in claim 1, wherein the at least one hollow launching tube is pivotally attached with the platform such that the object may be launched at a plurality of angles.

3. A method for forming a pneumatic launching apparatus, the method comprising acts of:

forming a collapsible bellows having a top portion and a bottom portion, the top portion having an outlet configured to allow air to exit the collapsible bellows;

attaching a gripping device with the collapsible bellows, attaching a platform with the gripping device;

forming at least one hollow launching tube attached with the platform, wherein the at least one hollow launching tube is formed to releasable engage an object; and connecting an air transfer tube with the collapsible bellows and the at least one hollow launching tube, wherein upon compression of the collapsible bellows, air travels from the collapsible bellows, through the air transfer tube, and out of the at least one hollow launching tube to launch an object attached with the at least one hollow launching tube;

forming the gripping device as a handle, such that a user may grip the handle and compress the bottom portion of the collapsible bellows against a surface to launch the object attached with the at least one hollow launching tube;

forming a rotating mechanism attached with the platform and configured to induce rotation of the platform; and forming the gripping device to further comprise a rotation actuator operably connected with the rotating mechanism to induce rotation of the platform.

4. A method for forming a pneumatic launching apparatus as set forth in claim 3, further comprising an act of forming the at least one hollow launching tube to be pivotally attached with the platform such that the object may be launched at a plurality of angles.

* * * * *